US008733085B2

(12) United States Patent
Marutani et al.

(10) Patent No.: US 8,733,085 B2
(45) Date of Patent: May 27, 2014

(54) BURNER APPARATUS

(75) Inventors: Youichi Marutani, Odawara (JP); Yasunori Ashikaga, Yokohama (JP); Syouji Itoh, Tokyo (JP); Akihiko Ogasawara, Azumino (JP); Mamoru Kurashina, Matsumoto (JP)

(73) Assignee: IHI Corporation (JP)

( * ) Notice: Subject to any disclaimer, the term of this patent is extended or adjusted under 35 U.S.C. 154(b) by 57 days.

(21) Appl. No.: 13/376,511

(22) PCT Filed: Jul. 14, 2010

(86) PCT No.: PCT/JP2010/061915

§ 371 (c)(1),
(2), (4) Date: Dec. 6, 2011

(87) PCT Pub. No.: WO2011/007808

PCT Pub. Date: Jan. 20, 2011

(65) Prior Publication Data

US 2012/0096840 A1 Apr. 26, 2012

(30) Foreign Application Priority Data

Jul. 14, 2009 (JP) ..... P2009-165869
Sep. 30, 2009 (JP) ..... P2009-226713

(51) Int. Cl.

| | |
|---|---|
| ***F01N 3/00*** | (2006.01) |
| ***F01N 3/10*** | (2006.01) |
| ***F01N 1/00*** | (2006.01) |
| ***F23D 14/62*** | (2006.01) |

(52) U.S. Cl.
USPC ..... 60/303; 60/286; 60/324; 431/354

(58) Field of Classification Search
USPC ..... 60/286, 295, 303, 324; 110/210–212, 110/214; 219/261, 267; 431/354
See application file for complete search history.

(56) References Cited

U.S. PATENT DOCUMENTS 4,951,464 A 8/1990 Eickhoff et al. ..... 60/274
5,056,501 A 10/1991 Ida ..... 126/110

(Continued)

FOREIGN PATENT DOCUMENTS

CN 1416517 A 5/2003
CN 1540143 A 10/2004

(Continued)

OTHER PUBLICATIONS

International Search Report and Written Opinion mailed Oct. 12, 2010 in corresponding PCT International Application No. PCT/JP2010/061915.

(Continued)

*Primary Examiner* — Audrey K Bradley
(74) *Attorney, Agent, or Firm* — Ostrolenk Faber LLP

(57) ABSTRACT

The present invention is a burner apparatus (S1, S2, S3, S4) that combusts air-fuel mixture (Y) of an oxidizing agent and fuel. This burner apparatus (S1, S2, S3, S4) includes a partitioning component (8) that separates an ignition chamber (R2) where the air-fuel mixture (Y) is ignited and a combustion holding chamber (R3) where the combustion of the air-fuel mixture (Y) is maintained such that the air-fuel mixture (Y) is able to pass between them, wherein the partitioning component (8) adjusts the flow rate of the air-fuel mixture (Y) that is supplied from the ignition chamber (R2) to the combustion holding chamber (R3).

7 Claims, 8 Drawing Sheets

(56) References Cited

U.S. PATENT DOCUMENTS

| | | | | |
|---|---|---|---|---|
| 5,379,592 | A | 1/1995 | Waschkuttis | 60/286 |
| 5,829,248 | A | 11/1998 | Clifton | 60/286 |
| 5,846,067 | A | 12/1998 | Nishiyama et al. | |
| 2009/0178394 | A1 * | 7/2009 | Crane, Jr. | 60/295 |

FOREIGN PATENT DOCUMENTS

| | | | |
|---|---|---|---|
| CN | 1633550 | A | 6/2005 |
| CN | 1982661 | A | 6/2007 |
| DE | 10 2004 048 335 | | 4/2006 |
| JP | 8-093555 | | 4/1996 |
| JP | 8-233226 | | 9/1996 |
| JP | 8-260944 | | 10/1996 |
| JP | 2000-110548 | | 4/2000 |
| JP | 2005-265344 | | 9/2005 |
| JP | 2007-154772 | | 6/2007 |
| KR | 10-0230940 | B1 | 8/1999 |
| KR | 2003-0040183 | A | 5/2003 |
| KR | 10-0515013 | B1 | 9/2005 |

OTHER PUBLICATIONS

Supplementary Search Report dated Mar. 20, 2012 issued in corresponding European Application No. 10799866.8 (5 pages).

Office Action dated Jun. 28, 2013 issued in corresponding Canadian Patent Application No. 2,767,366.

Chinese Office Action issued in corresponding Chinese Application No. 201080031286.X mailed on Oct. 17, 2013 (with English translation of Search Report only).

Notice of Allowance issued in corresponding Korean Application No. 10-2011-7031476 mailed on Oct. 28, 2013 (with English translation).

* cited by examiner

BURNER APPARATUS

CROSS-REFERENCE TO RELATED APPLICATIONS

The present application is a 35 U.S.C. §§371 national phase conversion of PCT/JP2010/061915, filed Jul. 14, 2010, which claims priority of Japanese Patent Application No. 2009-165869, filed Jul. 14, 2009, and Japanese Patent Application No. 2009-226713, filed Sep. 30, 2009, the contents of which are incorporated herein by reference. The PCT International Application was published in the Japanese language.

TECHNICAL FIELD

The present invention relates to a burner apparatus that combusts air-fuel mixture of an oxidizing agent and fuel.

TECHNICAL BACKGROUND

Minute particles (particulate matter) are contained in exhaust gas from a diesel engine and the like. The adverse effects on the environment when these minute particles are discharged into the atmosphere are a cause for serious concern. As a consequence, in recent years, a filter that is used to remove the minute particles from the exhaust gas (DPF) has been mounted on vehicles powered by the diesel engine and the like.

This filter is formed from ceramics and the like that are porous material which is provided with a plurality of holes which are smaller than the minute particles. This filter obstructs the passage of the minute particles, and collects the minute particles.

However, when the filter like this has been used for a prolonged period, the collected minute particles are accumulated therein and the filter becomes clogged.

In order to prevent the filter like this from becoming clogged, as is shown, for example, in Patent Document 1, the method is used in which high-temperature gas is supplied to the filter so that the collected minute particles in the filter are burned and removed.

Specifically, in Patent Document 1, a burner apparatus is placed between the diesel engine and the filter. Air-fuel mixture which exhaust gas and fuel were mixed is combusted in the burner apparatus so as to generate high-temperature gas. The minute particles are burned by supplying this high-temperature gas to the filter.

DOCUMENTS OF THE PRIOR ART

Patent Documents

[Patent Document 1] Japanese Patent Application, First Publication No. 2007-154772

DISCLOSURE OF THE INVENTION

Problems to be Solved by the Invention

In the above-described burner apparatus, fuel which is injected from a fuel injection system is mixed together with exhaust gas or the outside air which is supplied as an oxidizing agent so as to create air-fuel mixture. This air-fuel mixture is heated to its ignition temperature or more by an ignition system, thereby air-fuel mixture is ignited. The flame created by this ignition is maintained so as to continue the combustion.

However, if the flow rate of the oxidizing agent and the like supplied to the ignition system is high, then the flow rate of the air-fuel mixture supplied to the combustion chamber becomes high. In this case, there is a possibility that the combustion state in the combustion chamber will become unstable.

The present invention was conceived in view of the above described problems, and it is an object thereof to provide a burner apparatus that is able to stabilize the combustion state of air-fuel mixture, and to also generate high-temperature gas stably.

Means for Solving the Problem

The present invention employs the following structure as a means of solving the above-described problems.

The first aspect of the present invention is a burner apparatus that combusts air-fuel mixture of an oxidizing agent and fuel. This burner apparatus includes a partitioning component that separates an ignition chamber where the air-fuel mixture is ignited and a combustion holding chamber where the combustion of the air-fuel mixture is maintained such that the air-fuel mixture is able to pass between them. This partitioning component adjusts the flow rate of the air-fuel mixture that is supplied from the ignition chamber to the combustion holding chamber.

The second aspect of the present invention may employ the structure in which, in the above first aspect of the present invention, the partitioning component enables the air-fuel mixture to flow from the ignition chamber to the combustion holding chamber such that it collides with a flow of an oxidizing agent supplied from the outside to the combustion holding chamber.

The third aspect of the present invention may employ the structure in which, in the above first or second aspect of the present invention, the partitioning component is provided with through-holes that are communicated with both the ignition chamber and the combustion holding chamber, and enables the air-fuel mixture to flow from the ignition chamber to the combustion holding chamber through these through-holes.

The fourth aspect of the present invention may employ the structure in which, in any one of the above first through third aspects of the present invention, there is provided with a combustion assisting component that is placed in the combustion holding chamber.

The fifth aspect of the present invention may employ the structure in which, in any one of the above first through fourth aspects of the present invention, there is provided with a partitioning wall that separates at least the combustion holding chamber from an outer wall that is in contact with the outside air.

Effects of the Invention

In a conventional burner apparatus, because the ignition chamber and the combustion holding chamber are not partitioned, it is not possible to adjust the flow rate of the air-fuel mixture supplied to the combustion holding chamber.

In contrast to this, in the burner apparatus of the present invention, the ignition chamber and the combustion holding chamber are partitioned by a partitioning component such that the air-fuel mixture is able to pass between them. Because of this, it is possible to adjust the flow rate of the air-fuel mixture supplied from the ignition chamber to the combustion holding chamber. In other words, it is possible to adjust the flow rate of the air-fuel mixture supplied to the combustion holding chamber to a flow rate at which the combustion in the combustion holding chamber is stabilized.

Therefore, according to the burner apparatus of the present invention, it is possible to stabilize the combustion state of air-fuel mixture, and to also generate high-temperature gas stably.

EMBODIMENTS FOR IMPLEMENTING THE INVENTION

Hereinafter, an embodiment of a burner apparatus related to the present invention will be described with reference made to the drawings. Note that in the following drawings, the scales of respective components have been suitably altered in order to describe each component in a recognizable size.

First Embodiment

Figure 1:
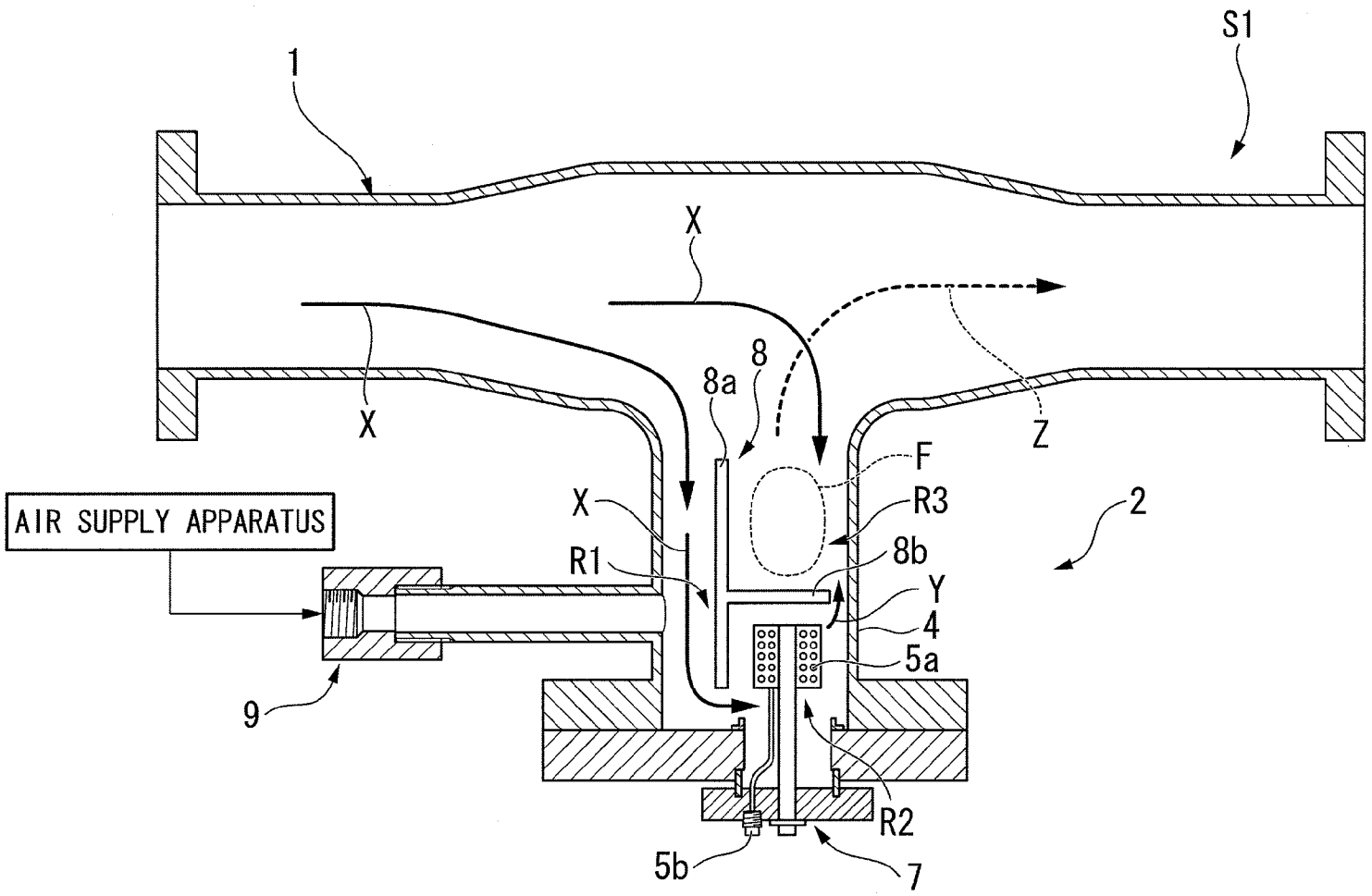
FIG. 1 is a cross-sectional view showing the schematic structure of a burner apparatus of the first embodiment of the present invention.

FIG. 1 is a cross-sectional view showing the schematic structure of a burner apparatus S1 of the present embodiment.

This burner apparatus S1 is connected to an exhaust outlet of an apparatus that expels exhaust gas such as a diesel engine or the like which is located on the upstream side of the burner apparatus S1. This burner apparatus S1 mixes together supplied exhaust gas X (i.e., an oxidizing agent) and fuel, and then combusts them so as to generate high-temperature gas Z. It also supplies this high-temperature gas Z to a downstream-side filter. The burner apparatus S1 is located, for example, between the diesel engine and a particulate filter, and is provided with a supply flow path 1 and a combustion unit 2.

The supply flow path 1 is a flow path which is used to supply the exhaust gas X, which is supplied from the diesel engine or the like, directly to the filter. This supply flow path 1 is formed in a circular cylinder-shaped pipe. One end portion of this supply flow path 1 is connected to an exhaust outlet of the diesel engine or the like, while the other end portion thereof is connected to the filter.

The combustion unit 2 is connected to the supply flow path 1. This combustion unit 2 mixes together a part of the exhaust gas X which flows through the supply flow path 1 and fuel therein, and then combusts them so as to generate high-temperature gas. This combustion unit 2 is provided with a pipe body 4, a fuel supply portion 5, an ignition system 7, a partitioning component 8, and a combustion supporting air supply apparatus 9.

The pipe body 4 is a pipe-shaped component which forms the outer shape of the combustion unit 2, and has a hollow interior. This pipe body 4 is connected to the supply flow path 1 in a perpendicular direction relative to the direction in which the supply flow path 1 extends.

The fuel supply portion 5 is provided with a fuel holding portion 5*a* which is located at the distal end of the ignition system 7, and with a supply portion 5*b* which is used to supply fuel to the fuel holding portion 5*a*. The fuel holding portion 5*a* is formed, for example, from metal, sintered metal, metal fibers, glass fabric, a ceramic porous body, ceramic fibers, or pumice or the like.

The ignition system 7 includes a glow plug which is a heater which is heated to a temperature equal to or greater than the ignition temperature of the air-fuel mixture of fuel and the exhaust gas X, and a distal end portion thereof is surrounded by the fuel holding portion 5*a*.

Figure 2:
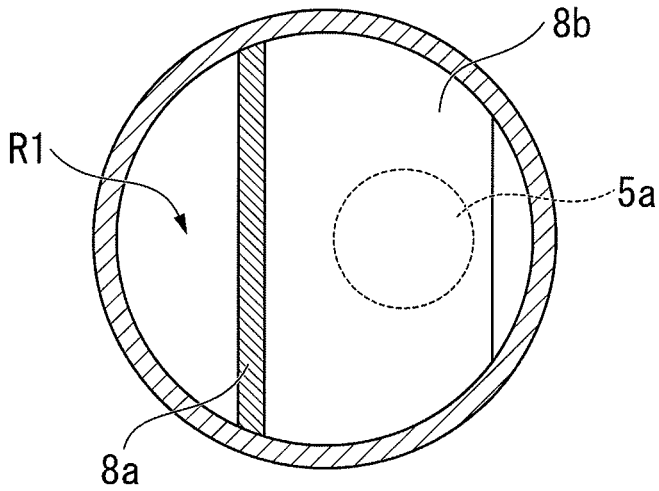
FIG. 2 is a view seen from above of a pipe body provided on the burner apparatus of the first embodiment of the present invention.

The partitioning component 8 partitions the interior of the pipe body 4 into an exhaust gas flow path R1 through which exhaust gas X supplied from the supply flow path 1 flows, an ignition chamber R2 where the ignition system 7 is located, and a combustion holding chamber R3 where the combustion of the air-fuel mixture Y is maintained. This partitioning component 8 is provided with a central plate 8*a* which extends vertically in a central portion of the pipe body 4 and which is located away from a bottom surface of the pipe body 4. As is shown in FIG. 2, this partitioning component 8 is also provided with a side plate 8*b* which extends horizontally from the central plate 8*a* and which is located away from a side surface of the pipe body 4. The surface area of the side plate 8*b* is set larger than the area viewed from above of the fuel holding portion 5*a*.

As is shown in FIG. 1, this partitioning component 8 causes the exhaust gas X to flow from the exhaust gas flow path R1 to the ignition chamber R2 through a gap between the central plate 8*a* and the bottom surface of the pipe body 4, and causes the air-fuel mixture Y to flow from the ignition chamber R2 to the combustion holding chamber R3 through a gap between the side plate 8*b* and the side surface of the pipe body 4.

This partitioning component 8 is positioned so that a gap is formed between itself and the pipe body 4, and causes the air-fuel mixture Y to pass from the ignition chamber R2 to the combustion holding chamber R3 through this gap. As a result, the flow rate of the air-fuel mixture Y is adjusted to a flow rate at which the combustion in the combustion holding chamber R3 is stabilized.

The partitioning component 8 causes the air-fuel mixture Y to flow from below toward above through the gap opened adjacent to the pipe body 4. Because of this, the air-fuel mixture Y is made to collide with the flow of the exhaust gas X (i.e., the flow of an oxidizing agent) which is supplied from above the combustion holding chamber R3 (i.e., outside) along the side wall of the pipe body 4 to the combustion holding chamber R3.

Note that the cross-sectional area of the flow passage from the exhaust gas flow path R1 to the ignition chamber R2 is preferably larger than the cross-sectional area of the flow passage from the ignition chamber R2 to the combustion holding chamber R3. By doing this, the ignition chamber R2 is kept constantly full of gas, and the flow rate of fluid in the ignition chamber R2 is reduced so that the ignitability thereof is improved.

The combustion supporting air supply apparatus 9 accessorily supplies air to the interior of the pipe body 4 (i.e., to the exhaust gas flow path R1) as necessary. This combustion supporting air supply apparatus 9 is provided with an air supply apparatus which supplies air, and with piping and the like which connect this air supply apparatus to the interior of the pipe body 4.

In the burner apparatus S1 of the present embodiment, the exhaust gas X which flows from the supply flow path 1 to the exhaust gas flow path R1 is supplied as an oxidizing agent from the exhaust gas flow path R1 to the ignition chamber R2.

Meanwhile, the ignition system 7 is heated under the control of a control unit (not shown), and fuel which is supplied from the supply portion 5*b* to the fuel holding portion 5*a* is volatilized in the ignition chamber R2.

Next, the air-fuel mixture Y is created by mixing the exhaust gas X supplied to the ignition chamber R2 together with the volatilized fuel, and this air-fuel mixture Y is then ignited by being heated to a temperature equal to or more than its ignition temperature by the ignition system 7.

Note that the cross-sectional area of the flow passage from the exhaust gas flow path R1 to the ignition chamber R2 is set to be larger than the cross-sectional area of the flow passage from the ignition chamber R2 to the combustion holding chamber R3. By doing this, the ignition chamber R2 is kept constantly full of gas, and the flow rate of fluid in the ignition chamber R2 is reduced. Accordingly, it is possible to easily ignite the air-fuel mixture Y in the ignition chamber R2.

When the air-fuel mixture Y is ignited in the ignition chamber R2 in this manner, the flame created by this ignition is propagated to the combustion holding chamber R3 together with uncombusted air-fuel mixture Y. As a result of this, a flame F is created in the combustion holding chamber R. Uncombusted air-fuel mixture Y and the exhaust gas X supplied from above the combustion holding chamber R3 are supplied to the flame F, resulting in the flame F being maintained and combusted stably. In addition, by this flame F being maintained, then the high-temperature gas Z can be generated stably.

Here, in the burner apparatus S1 of the present embodiment, the ignition chamber R2 and the combustion holding chamber R3 are partitioned by the partitioning component 8 such that the air-fuel mixture Y is able to pass between them. Furthermore, the flow rate of the air-fuel mixture Y supplied from the ignition chamber R2 to the combustion holding chamber R3 is adjusted to a flow rate at which the combustion in the combustion holding chamber R3 is stabilized.

Therefore, according to the burner apparatus S1 of the present embodiment, it is possible to stabilize the combustion state of the air-fuel mixture Y, and to also generate the high-temperature gas Z stably.

Moreover, in the burner apparatus S1 of the present embodiment, the air-fuel mixture Y which is supplied from the ignition chamber R2 to the combustion holding chamber R3 collides with the exhaust gas X which is supplied to the combustion holding chamber R3 from above. Consequently, it is possible to reduce the flow rates of the exhaust gas X and the air-fuel mixture Y in the combustion holding chamber R3, and the combustion taking place in the combustion holding chamber R3 can be made to proceed more stably.

Second Embodiment

Next, the second embodiment of the present invention will be described. Note that in the description of the present embodiment, any description of structure that is the same as in the above described first embodiment is either omitted or simplified.

Figure 3:
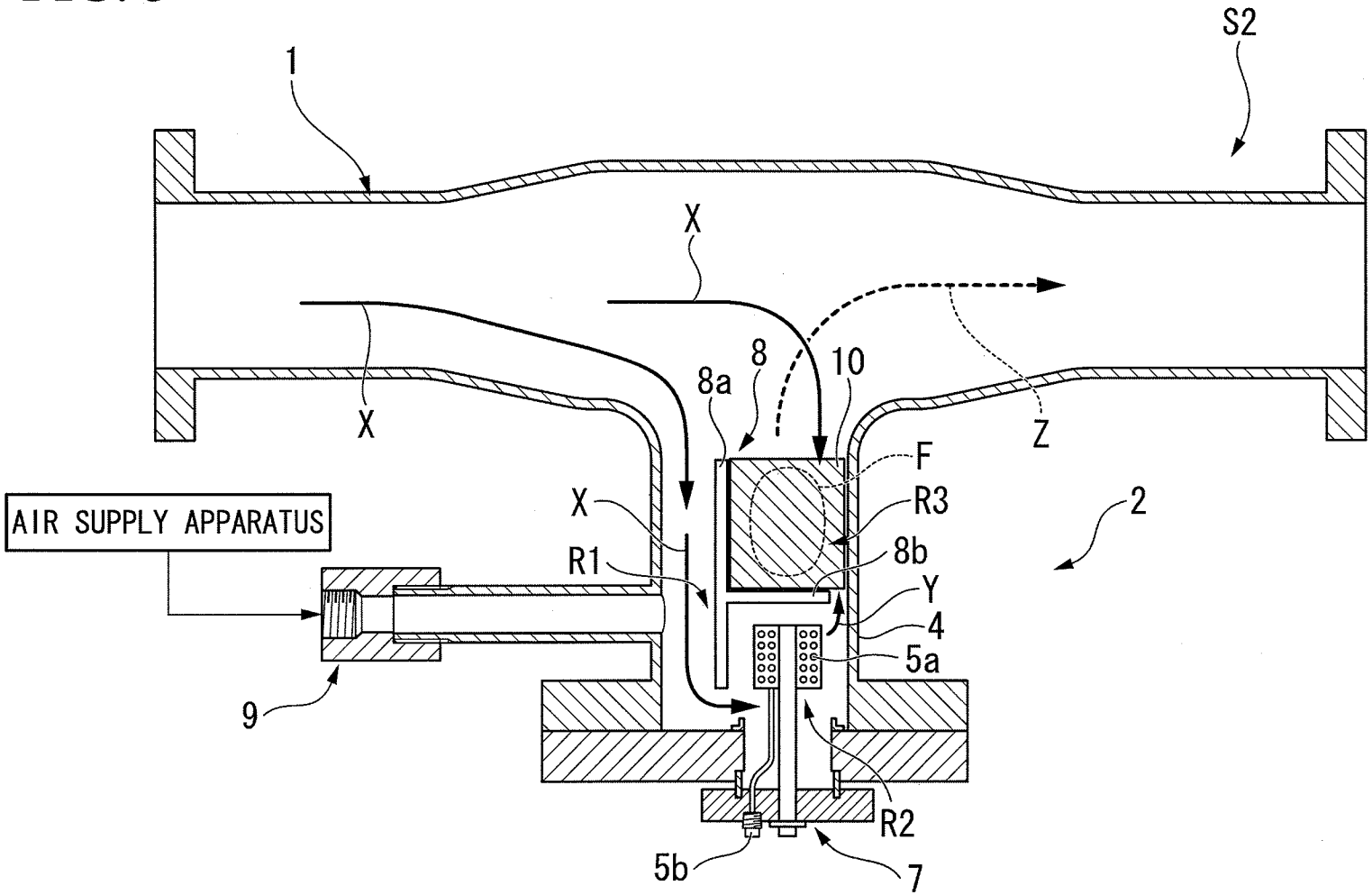
FIG. 3 is a cross-sectional view showing the schematic structure of a burner apparatus of the second embodiment of the present invention.

FIG. 3 is a cross-sectional view showing the schematic structure of a burner apparatus S2 of the present embodiment. As is shown in this figure, the burner apparatus S2 of the present embodiment is provided with a combustion assisting component 10 which is placed in the combustion holding chamber R3.

The combustion assisting component 10 assists the combustion in the combustion holding chamber R3, and inhibits any poor burning of the flame F.

For this combustion assisting component 10, it is possible to use a ceramic porous body that maintains the temperature of the combustion holding chamber at a high temperature by being heated by the flame F to equal to or more than the ignition temperature, or a catalyst or the like that is self-burned by being heated so as to inhibit any poor burning of the flame F.

According to the burner apparatus S2 of the present embodiment which has the above described structure, because the combustion in the combustion holding chamber R3 is assisted by the combustion assisting component 10, it is possible to further stabilize the combustion in the combustion holding chamber R3.

Third Embodiment

Next, the third embodiment of the present invention will be described. Note that in the description of the present embodiment as well, any description of structure that is the same as in the above described first embodiment is either omitted or simplified.

Figure 4:
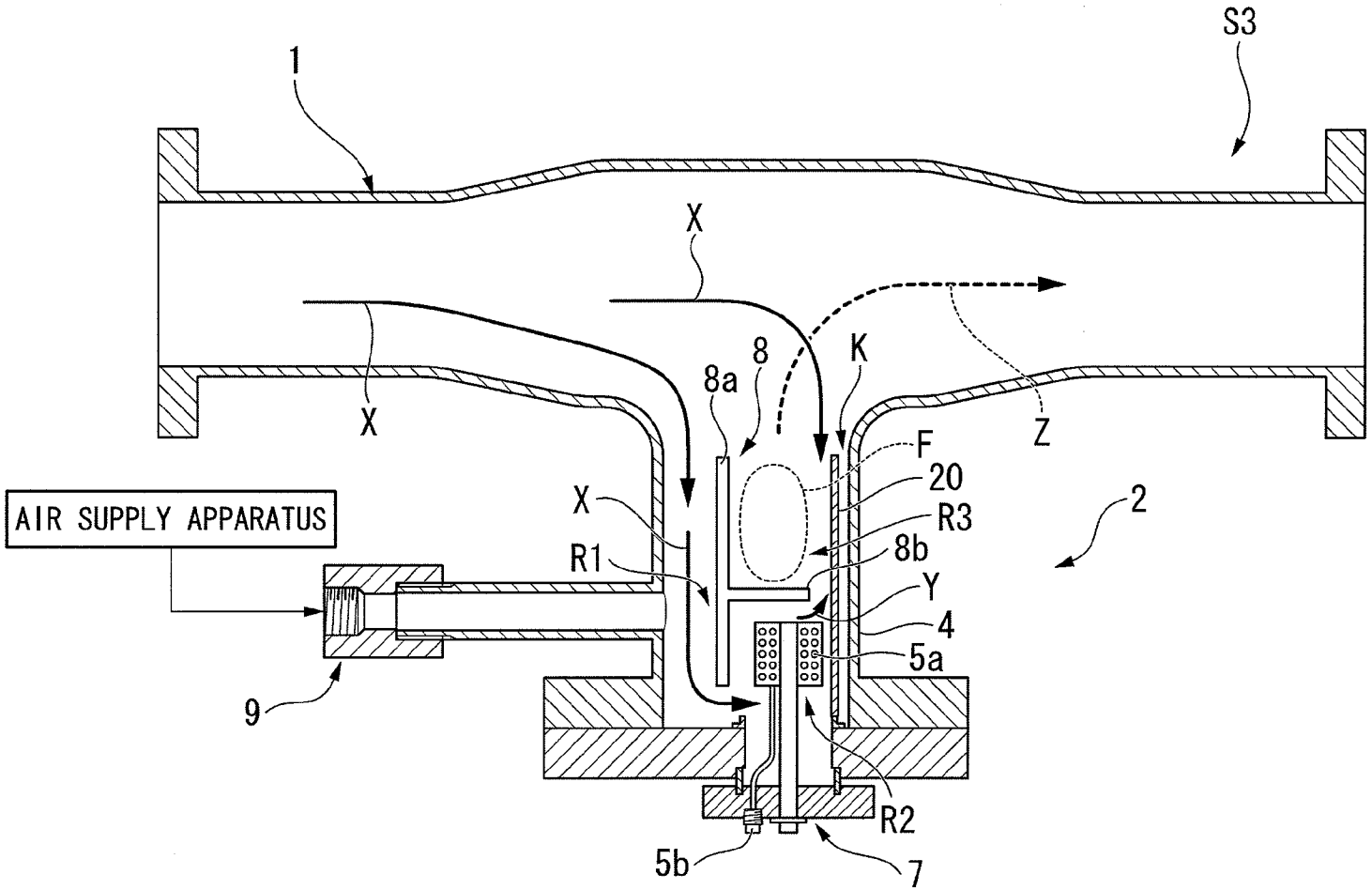
FIG. 4 is a cross-sectional view showing the schematic structure of a burner apparatus of the third embodiment of the present invention.
Figure 5:
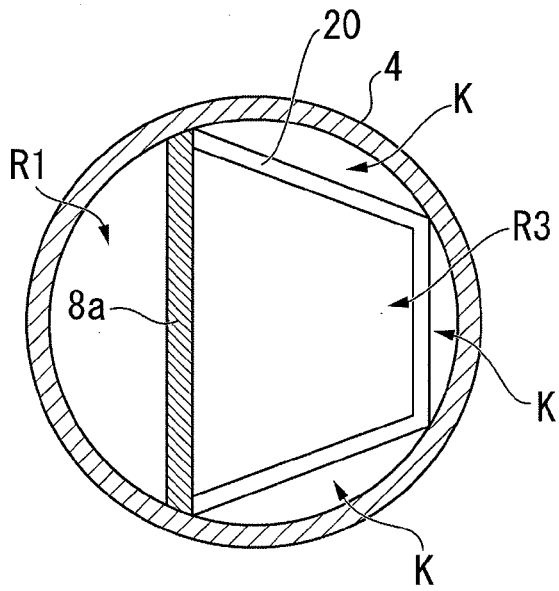
FIG. 5 is a view seen from above of a pipe body provided on the burner apparatus of the third embodiment of the present invention.

FIG. 4 is a cross-sectional view showing the schematic structure of a burner apparatus S3 of the present embodiment. FIG. 5 is a view seen from above of a pipe body provided on the burner apparatus of the present embodiment. As is shown in FIG. 5, the burner apparatus S3 of the present embodiment is provided with a partitioning wall 20 (i.e., a partitioning wall) which separates the combustion holding chamber R3 from a wall surface of the pipe body 4 which is an external wall which is in contact with the outside air.

As is shown in FIG. 5 in which the pipe body 4 is seen from above, the partitioning wall 20 has an opened polygonal shape. Moreover, this partitioning wall 20 is supported by apex portions thereof being in contact with the circular pipe body 4. As a result, spaces K are formed between the partitioning wall 20 and an inner wall surface of the pipe body 4 in areas excluding the apex portions. By forming these spaces K, the combustion holding chamber R3 is separated from the wall surface of the pipe body 4.

According to the burner apparatus S3 of the present embodiment which has the above described structure, the pipe body 4 which is cooled to a low temperature to be exposed to the outside air is separated by the partitioning wall 20 via the spaces K from the combustion holding chamber R3. Consequently, it is possible to prevent the combustion holding chamber R3 from being cooled, and to further stabilize the combustion in the combustion holding chamber R3.

Fourth Embodiment

Next, the fourth embodiment of the present invention will be described. Note that in the description of the present embodiment as well, any description of structure that is the same as in the above described first embodiment is either omitted or simplified.

Figure 6:
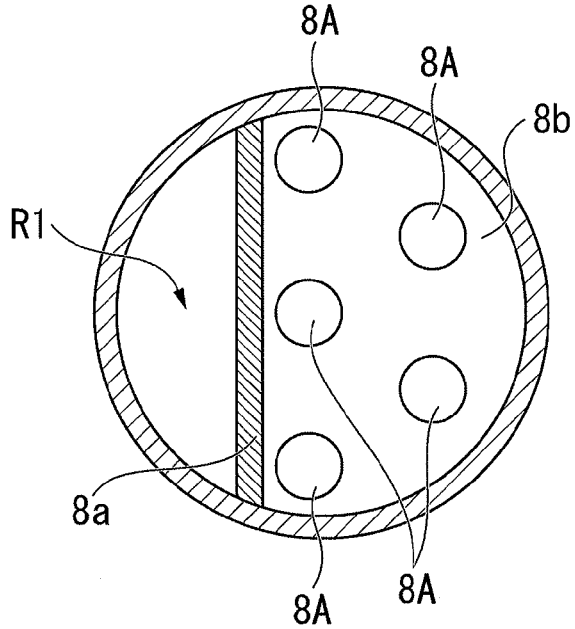
FIG. 6 is a view seen from above of a pipe body provided on a burner apparatus of the fourth embodiment of the present invention.

FIG. 6 is a cross-sectional view showing the schematic structure of a burner apparatus S4 of the present embodiment, and is a view seen from above of a side plate 8*b*.

As is shown in this figure, the side plate 8*b* of the present embodiment is in contact with and is connected to the entire side wall of the pipe body 4 so as to entirely close off the space on the combustion holding chamber R3 side in the interior spaces of the pipe body 4 which have been divided in half by a central plate 8*a*. Furthermore, circular holes 8A (i.e., through-holes) that enable the air-fuel mixture Y to pass through are formed in the side plate 8*b*.

A majority of the circular holes 8A are formed on the central plate 8*a* side (i.e., the upstream side), in contrast a minority of the circular holes 8A are formed on the inner wall side (i.e., the downstream side) of the pipe body 4. As a result, the opening area created by the circular holes 8A in the side plate 8*b* is relatively large on the upstream side in the flow direction of the air-fuel mixture Y, and is relatively small on the downstream side thereof.

According to the burner apparatus S4 of the present embodiment which employs the above described structure, the air-fuel mixture Y is supplied to the combustion holding chamber R3 through the narrow circular holes 8A. As a consequence, the flow of the air-fuel mixture Y is stirred, so that the mixing of the air-fuel mixture Y in the combustion holding chamber R3 is accelerated, and a preferable combustion of the air-fuel mixture can be achieved.

Moreover, in the burner apparatus S4 of the present embodiment, the opening area in the side plate 8*b* is relatively large on the upstream side in the flow direction of the air-fuel mixture Y, and is relatively small on the downstream side thereof. As a consequence, a more quantity of the air-fuel mixture Y is supplied to the combustion holding chamber R3 from the upstream side of the side plate 8*b*. As a result, it is possible to supply the air-fuel mixture Y to the combustion holding chamber R3 without obstructing the gas flow in the combustion holding chamber R3.

Note that it is preferable for the opening area on the upstream side of the side plate 8*b* to be approximately 1.5 times the opening area on the downstream side thereof.

It is also desirable for the sum of the areas of all of the circular holes 8A to be between 5% and 20% of the internal cross-sectional area of the pipe body 4*a*.

Figure 7:
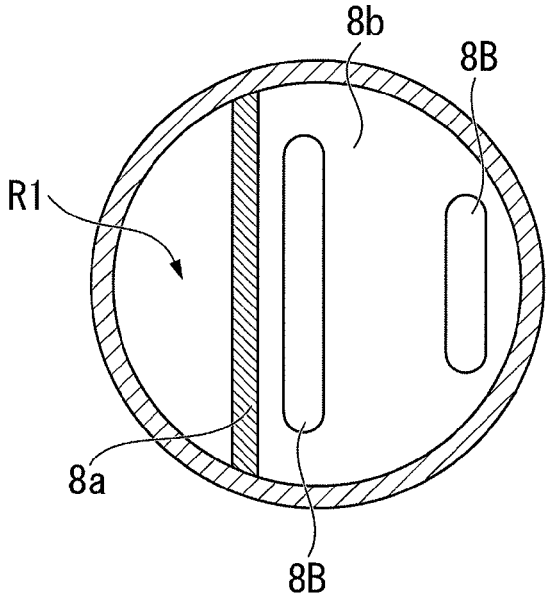
FIG. 7 is a view showing a variant example of the burner apparatus of the fourth embodiment of the present invention.

Moreover, in the present embodiment, the through-holes are in the form of the circular holes 8A, however, for example, as is shown in FIG. 7, it is also possible for the through-holes to be in the form of elongated holes 8B.

In this case as well, it is preferable for the opening area in the side plate 8*b* to be relatively large on the upstream side in the flow direction of the air-fuel mixture Y, and to be relatively small on the downstream side thereof. It is also preferable to make the elongated holes 8B on the upstream side in the flow direction of the air-fuel mixture Y relatively long, and to make the elongated holes 8B on the downstream side thereof relatively short.

Preferred embodiments of the present invention have been described above with reference made to the figures, however, the present invention is not limited to the above embodiments. The various configurations and combinations and the like of the respective component elements illustrated in the above described embodiments are merely examples thereof. Various modifications and the like to the present invention may be made based on the design requirements and the like insofar as they do not depart from the spirit or scope of the present invention.

For example, in the above described embodiments, the air-fuel mixture Y flows from the ignition chamber R2 to the combustion holding chamber R3 through the gap that is formed by the side plate 8*b* being separated from the side surface of the pipe body 4.

However, the present invention is not limited to this. For example, it is also possible to form the horizontal cross-sectional shape of the pipe body 4 as a square shape, and to place the side plate 8*b* in contact with the side surface of the pipe body 4. Additionally, as is shown in FIG. 8, it is possible to form through-holes 8*c* in the side plate 8*b* and thereby enable the air-fuel mixture Y to flow from the ignition chamber R2 to the combustion holding chamber R3 through these through-holes 8*c*.

Figure 8:
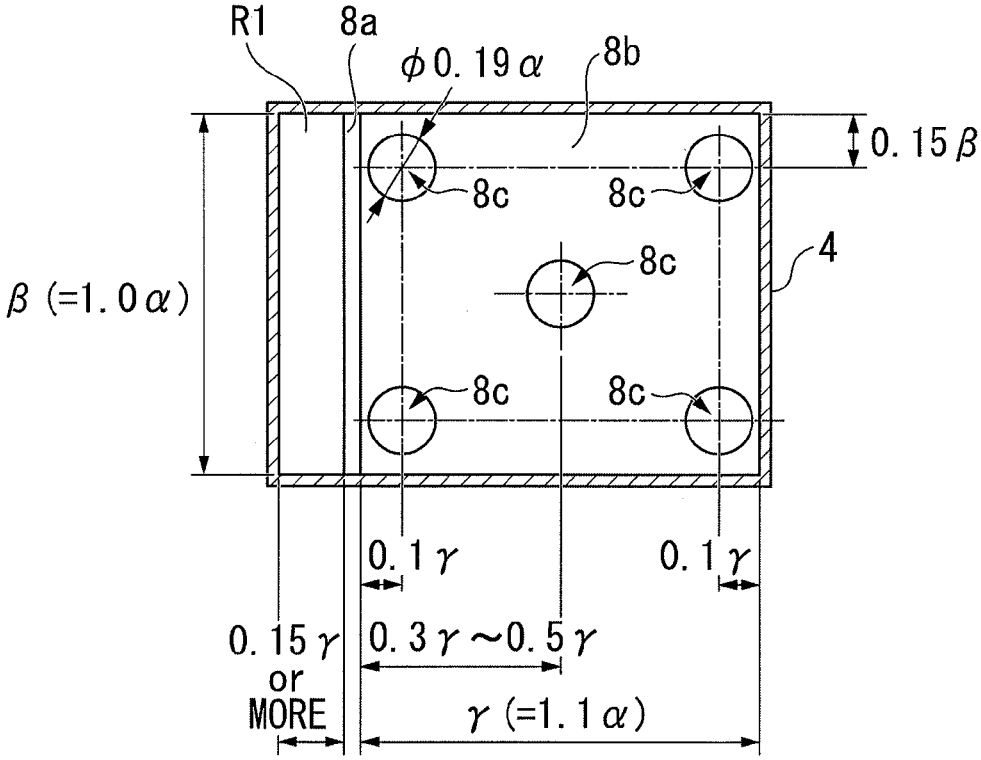
FIG. 8 is a view showing a variant example of a side plate provided on the burner apparatus of the first embodiment of the present invention.

When the structure shown in FIG. 8 is employed, for example, if the diameter of the supply flow path 1 is taken as $\alpha$, then the horizontal width $\gamma$ of the side plate 8*b* (i.e., the width thereof in a perpendicular direction relative to the surface of the central plate 8*a*) is 1.1 $\alpha$, the vertical width $\beta$ of the side plate 8*b* (i.e., the width thereof in a direction along the surface of the central plate 8*a*) is 1.0 $\alpha$, the horizontal width of the exhaust gas flow path R1 (i.e., the width thereof in a perpendicular direction relative to the surface of the central plate 8*a*) is 0.15 $\gamma$ or more, and the vertical width of the exhaust gas flow path R1 (i.e., the width thereof in a direction along the surface of the central plate 8*a*) is $\beta$. Moreover, the diameter of the through-holes 8*c* is 0.19 a (found by experiment to be approximately 8 mm), and a total of 5 through-holes 8*c* are located at the four corners and at the center of the side plate 8*b*. Furthermore, the centers of the through-holes 8*c* that are located at the four corners of the side plate 8*b* are located at a position of 0.1 $\gamma$ from the edges in the horizontal width direction of the side plate 8*b*, and at a position of 0.15 $\beta$ from the edges in the vertical width direction of the side plate 8*b*. In addition, the center of the through-hole 8*c* that is located in the center of the side plate 8*b* is located at a position between 0.3 $\gamma$ and 0.5 $\gamma$ from the surface of the central plate 8*a*, and at a position of the middle in the horizontal width direction of the side plate 8*b*.

By employing the structure like this, the combustion in the combustion holding chamber R3 is stabilized.

Figure 9:
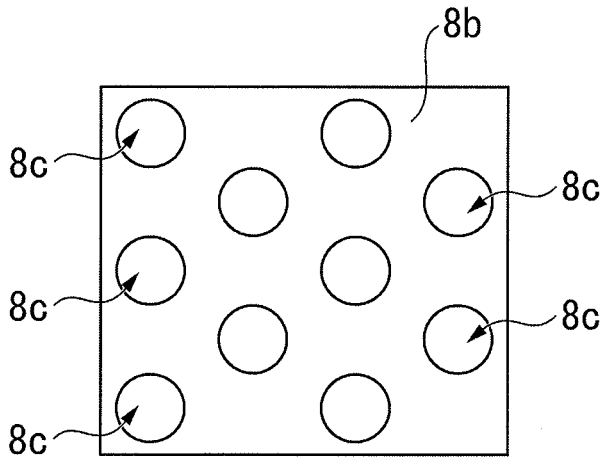
FIG. 9 is a plan view showing a variant example of the side plate shown in FIG. 8.

Moreover, as is shown in FIG. 9, even when 10 through-holes 8*c* having a diameter of 0.14 $\alpha$ (found by experiment to be approximately 6 mm) are formed in the side plate 8*b*, the combustion in the combustion holding chamber R3 is stabilized.

In addition, it is also possible to enable the air-fuel mixture Y to flow from the ignition chamber R2 to the combustion holding chamber R3 by forming the side plate 8*b*, for example, into a fine mesh.

Moreover, in the above described embodiments, the combustion supporting air supply apparatus 9 is provided. However, when the density of the oxygen contained in the exhaust gas X is sufficiently high, it is possible to omit the combustion supporting air supply apparatus 9.

Furthermore, in the above described embodiments, the exhaust gas X is used as an oxidizing agent.

However, the present invention is not limited to this and it is also possible to use air as an oxidizing agent.

In this case, for example, an end portion of the exhaust gas flow path R1 that is connected to the supply flow path 1 may be closed, and air may be supplied from the combustion supporting air supply apparatus 9 not as an auxiliary, but as a main oxidizing agent.

Figure 10:
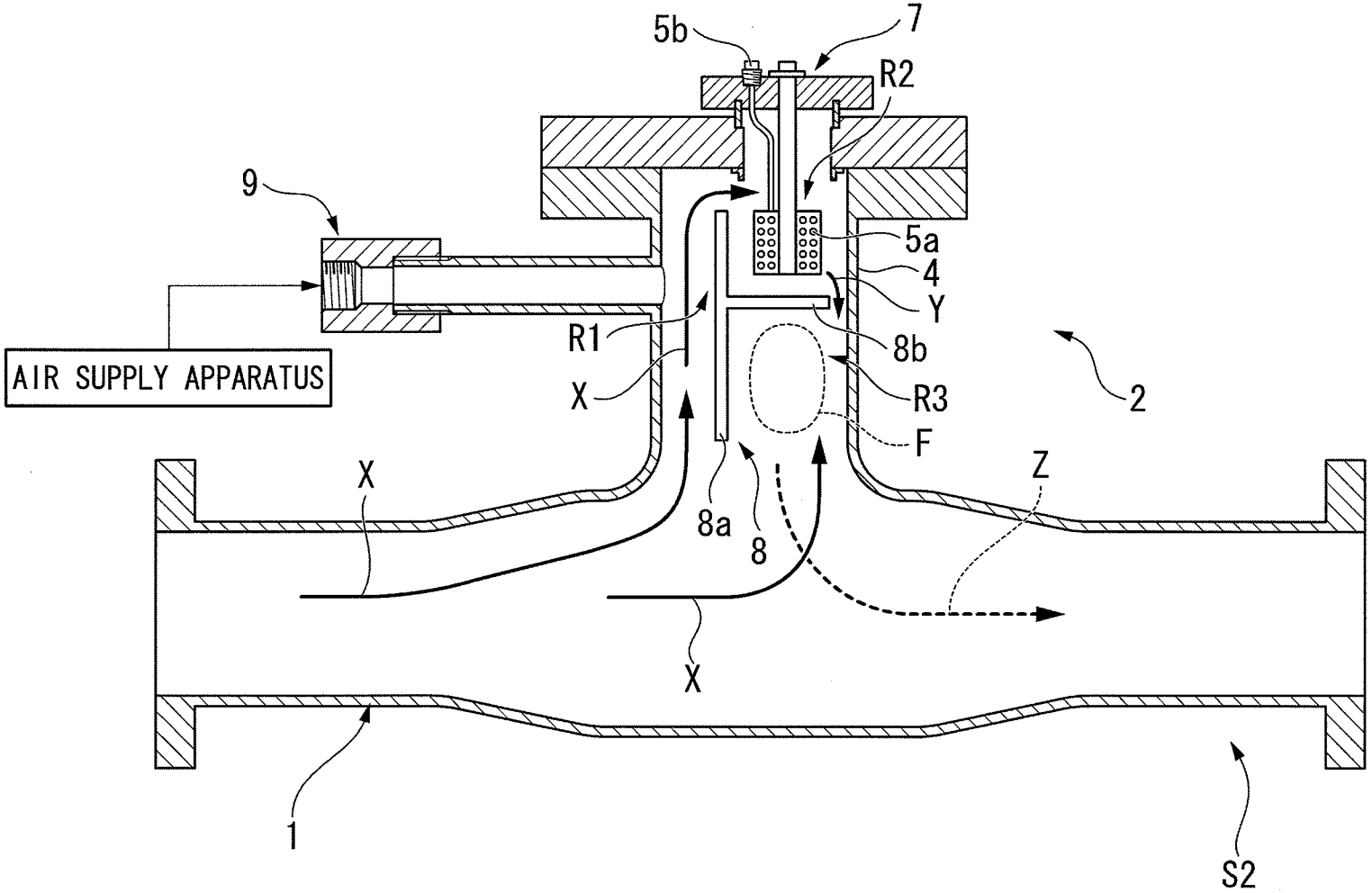
FIG. 10 is a view showing a variant example of the side plate provided on the burner apparatus of the first embodiment of the present invention.

Moreover, as is shown in FIG. 10, it is also possible for the pipe body 4, the internal structure thereof, and the connecting structure to be symmetrically inverted vertically. In this case, the pipe body 4, the internal structure thereof (i.e., the partitioning component 8, the fuel supply portion 5, the ignition system 7, and the like), and the connecting structure (i.e., the combustion supporting air supply apparatus 9) are mounted above the supply flow path 1.

Note that in FIG. 10, the pipe body 4, the internal structure thereof, and the connecting structure are provided on the burner apparatus S1 of the above described first embodiment so as to be symmetrically inverted vertically. However, it is also possible for the pipe body 4, the internal structure thereof, and the connecting structure to be provided on the burner apparatuses S2 to S4 of the second through fourth embodiments as well as on variant examples thereof, so as to be symmetrically inverted vertically.

Furthermore, in the above described embodiments, the supply portion 5*b* which is connected to the fuel holding portion 5*a* is used. However, the present invention is not limited to this and it is also possible to use a supply portion that sprays fuel onto the fuel holding portion 5*a*.

INDUSTRIAL APPLICABILITY

In the burner apparatus of the present invention, an ignition chamber and a combustion holding chamber are partitioned by a partitioning component so that air-fuel mixture is able to pass between them. Because of this, it is possible to adjust the flow rate of the air-fuel mixture supplied from the ignition chamber to the combustion holding chamber. In other words, it is possible to adjust the flow rate of the air-fuel mixture supplied to the combustion holding chamber to a flow rate at which the combustion in the combustion holding chamber is stabilized. Therefore, according to the burner apparatus of the present invention, it is possible to stabilize the combustion state of the air-fuel mixture, and to also generate high-temperature gas stably.

DESCRIPTION OF THE REFERENCE NUMERALS

S1 to S4 . . . . Burner apparatus
8 . . . . Partitioning component
8*a* . . . . Central plate
8*b* . . . . Side plate
8*c* . . . . Through-hole
8A . . . . Circular hole (Through-hole)
8B . . . . Elongated hole (Through-hole)
10 . . . Combustion assisting component
20 . . . . Partitioning wall
R2 . . . . Ignition chamber
R3 . . . . Combustion holding chamber
X . . . . Exhaust gas (Oxidizing agent)
Y Air-fuel mixture
Z . . . . High-temperature gas

What is claimed is:

1. A burner apparatus that combusts an air-fuel mixture of an oxidizing agent and fuel, comprising:

a supply flow path having an upstream end and a downstream end in which exhaust gas used as the oxidizing agent flows;

a pipe body connected to the supply flow path through a connecting portion positioned between both ends of the supply flow path, and the pipe body having a hollow interior; and a partitioning component that separates the interior of the pipe body, into an exhaust gas flow path in which the oxidizing agent supplied from the supply flow path through the connecting portion flows, an ignition chamber where the air-fuel mixture composed of the oxidizing agent supplied from the exhaust gas flow path and the fuel is ignited, and a combustion holding chamber where combustion of the air-fuel mixture supplied from the ignition chamber is maintained, wherein the pipe body is configured so that high-temperature gas generated by combusting the air-fuel mixture in the combustion holding chamber flows from the combustion holding chamber into the supply flow path through the connecting portion, and the partitioning component is configured to adjust a flow rate of the air-fuel mixture that is supplied from the ignition chamber to the combustion holding chamber.

2. The burner apparatus according to claim 1, wherein the partitioning component enables the air-fuel mixture to flow from the ignition chamber to the combustion holding chamber such that the air-fuel mixture collides with a flow of other exhaust gas supplied from the supply flow path to the combustion holding chamber through the connecting portion.

3. The burner apparatus according to claim 1, wherein the partitioning component enables the air-fuel mixture to flow from the ignition chamber to the combustion holding chamber through through-holes that are communicated with both the ignition chamber and the combustion holding chamber.

4. The burner apparatus according to claim 1, wherein there is provided a partitioning wall that separates at least the combustion holding chamber from an outer wall that is in contact with the outside air.

5. The burner apparatus according to claim 1, wherein the burner apparatus is configured to combust the air-fuel mixture composed of part of the exhaust gas which flows through the supply flow path and the fuel, in the pipe body.

6. The burner apparatus according to claim 1, wherein there is provided a combustion assisting component that is placed in the combustion holding chamber.

7. The burner apparatus according to claim 6, wherein the combustion assisting component is a catalyst to inhibit poor burning of the flame which is created in the combustion holding chamber.

* * * * *